US005096363A

United States Patent [19]

Weinert et al.

[11] Patent Number: 5,096,363

[45] Date of Patent: Mar. 17, 1992

[54] MULTIPLE-PAIR FORK POSITIONER

[75] Inventors: Harry F. Weinert, Portland; Dennis W. Gaibler, Gresham; Troy J. Schweitzer, Tualatin; David W. Petronek, Sandy, all of Oreg.

[73] Assignee: Cascade Corporation, Portland, Oreg.

[21] Appl. No.: 588,067

[22] Filed: Sep. 25, 1990

[51] Int. Cl.[5] ..... B66F 9/14

[52] U.S. Cl. ..... 414/667; 414/671

[58] Field of Search ..... 414/662, 663, 664, 665, 414/666, 667, 668, 669, 670, 671, 672

[56] References Cited

U.S. PATENT DOCUMENTS 4,533,290 8/1985 Hackauf ..... 414/667

FOREIGN PATENT DOCUMENTS 342500 7/1977 Austria .

0355668 2/1990 European Pat. Off. ..... 414/667

3515524 11/1986 Fed. Rep. of Germany ..... 414/671

3702918 8/1988 Fed. Rep. of Germany ..... 414/667

OTHER PUBLICATIONS

Cascade Corporation drawing "Double Fork Positioner", (undated).

*Primary Examiner*—Robert J. Spar

*Assistant Examiner*—James Keenan

*Attorney, Agent, or Firm*—Chernoff, Vilhauer, McClung & Stenzel

[57] ABSTRACT

A lift truck fork positioner for respective inner and outer pairs of load-handling forks includes power actuators for selectively extending and retracting the outer pair of forks and latch assemblies for selectively detachably connecting an inner fork fixedly to a respective adjacent outer fork in spaced relation thereto automatically in response to the extension of the outer forks beyond a predetermined inner range of extension. Each latch assembly, when connecting the inner fork to the outer fork, fixedly prevents any narrowing of the spacing between the interconnected inner and outer forks, as well as fixedly preventing any widening of such spacing.

7 Claims, 5 Drawing Sheets

MULTIPLE-PAIR FORK POSITIONER

BACKGROUND OF THE INVENTION

The present invention relates to positioners for multiple pairs of load-handling forks mounted on a lift truck, such multiple pairs including at least an outer pair of forks and an inner pair located between the outer pair. Multiple-pair fork positioners enable a lift truck to selectively carry either a single palletized load or multiple palletized loads in side-by-side relation, depending upon the adjustable positions of the forks.

Some types of multiple-pair fork positioners have required a separate powered actuator for each fork in order to adjust the positions of the forks. However, such a multiplicity of actuators adds unnecessary weight and expense to the lift truck's load-handling assembly. In order to limit the number of powered actuators required, other multiple-pair fork positioners have provided powered actuators only for the outer pair of forks, while the inner pair of forks are selectively moved in unison with the outer pair of forks over a limited range of movement. For example, U.S. Pat. No. 4,533,290 and Austrian Patent No. 342500 disclose positioners which provide limited extension and retraction of the inner forks in unison with the extension and retraction of the outer forks. However, neither discloses a structure capable of fixedly maintaining a constant spacing between the adjacent inner and outer forks in the outer range of extension of the outer forks. Likewise, German published patent application No. DE 3702918, although disclosing stops on the outer fork slides which pull the inner forks outwardly with the outer forks to the full extension of the outer forks, provides only a tension spring to prevent any narrowing of the spacing between the adjacent inner and outer forks. Therefore, obstacles or frictional binding of the inner forks during retraction of the outer forks can cause inadvertent narrowing of such spacing merely by overcoming the spring force.

Any fork positioner which does not fixedly prevent both widening and narrowing of the spacing between the adjacent inner and outer forks, during extension or retraction of the outer forks in their outer range of extension, can cause severe load handling problems. For example, if the forks are supporting a palletized load, a widening of the spacing during extension, caused by an obstacle or frictional binding impeding the extension of the inner fork, may pull the pallet apart and cause the load to fall off of the forks. Conversely, a narrowing of the spacing during retraction may destabilize the support of the load by the forks, likewise causing the load to fall off of the forks. Alternatively, if the forks are unloaded during such extension or retraction, the positioning of adjacent inner and outer forks to engage a pallet may be rendered difficult or impossible if the fork spacing is varied by obstacles or frictional binding impeding the movement of the inner fork, since the spacing of the adjacent forks may then not match the spacing of the pallet fork pockets.

A multiple-pair fork positioner has been previously marketed by Cascade Corporation of Portland, OR which provides a hinged linkage between adjacent inner and outer forks. The hinged linkage, in response to extension of the outer forks, extends to a locked position which, upon locking, bidirectionally maintains a fixed spacing between the inner and outer forks during their subsequent extension and retraction within the outer range of extension of the outer forks. However, such linkage does not provide a detachable connection between the adjacent inner and outer forks and therefore has substantial length which is susceptible to bending or other damage by contact with loads or other obstacles. Moreover, the linkage does not permit any adjustment in the fixed spacing between the adjacent inner and outer forks to accommodate different spacings of pallet fork pockets or different sized loads.

SUMMARY OF THE INVENTION

The present invention overcomes the foregoing deficiencies of the prior art by providing a powerextensible outer pair of forks, together with an inner pair of forks having respective latch mechanisms which detachably fixedly connect each inner fork to a respective adjacent outer fork automatically in response to the extension of the outer forks from an inner range of extension into an outer range of extension. Conversely, when the outer forks are retracted inwardly within the inner range of extension, the latch mechanisms automatically detach the inner forks from the outer forks. When connecting the inner forks to the outer forks, the latch mechanisms fixedly prevent any narrowing of the spacing between each inner fork and the adjacent outer fork, as well as fixedly preventing any widening of such spacing.

Thus, within the outer range of extension of the outer forks, and regardless of whether the outer forks are being extended or retracted in such outer range, the spacing between each interconnected inner fork and outer fork is bidirectionally fixedly maintained at a constant spacing by the latch mechanism. Accordingly, no frictional binding or other obstacle tending to impede the movement of the inner fork during the extension or retraction of the outer fork within the outer range of extension can change the spacing between the interconnected inner fork and outer fork, either in a direction tending to narrow the spacing or widen it. This result is obtained without the need for any other interconnecting linkage between the outer and inner forks which could be susceptible to damage Rather, the detachable connection provided by the latch mechanism eliminates any need for such linkage while also providing adjustability of the fixed spacing.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
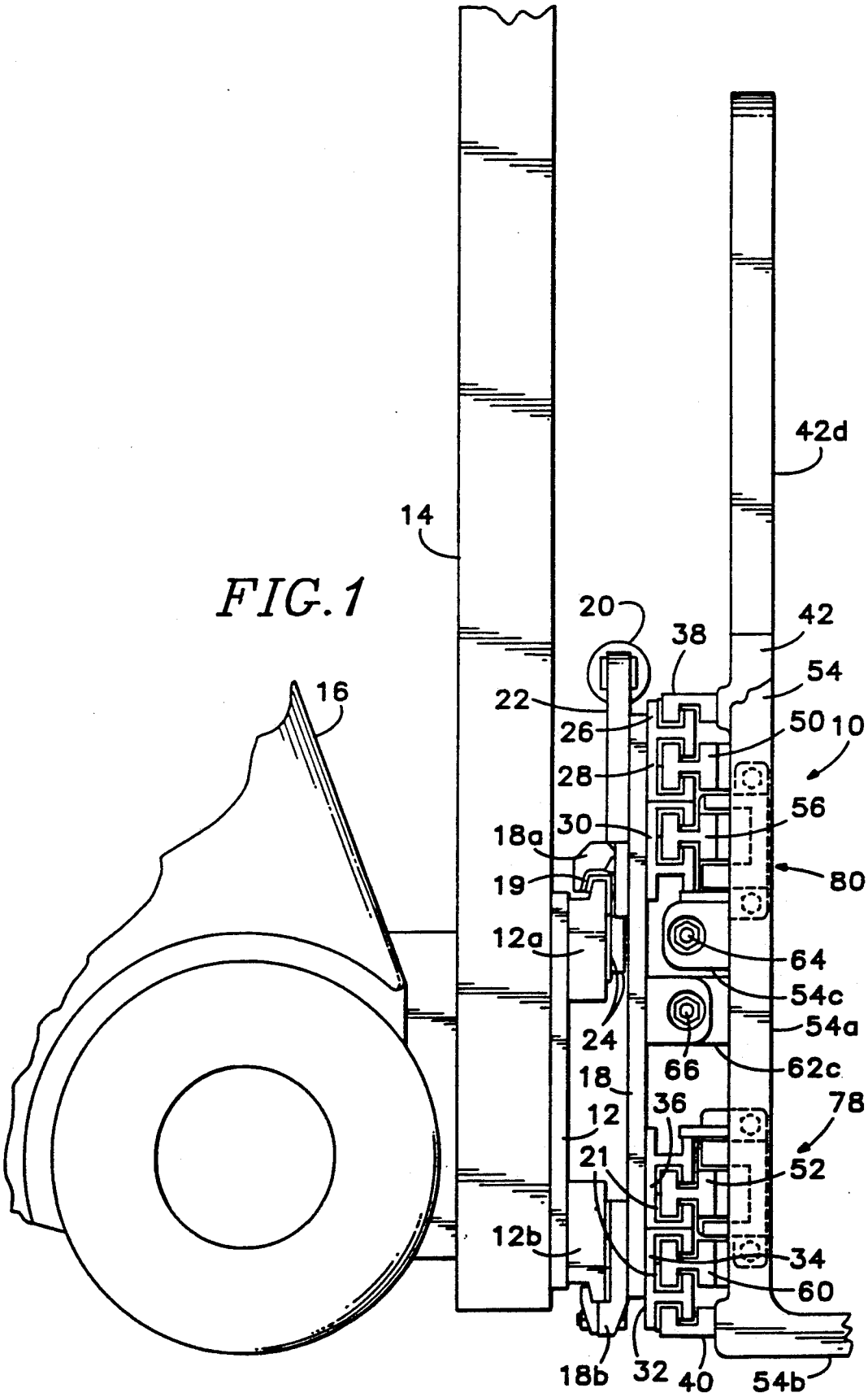
FIG. 1 is a side view of an exemplary embodiment of a multiple-pair fork positioner constructed in accordance with the present invention, shown mounted on a conventional lift truck.

An exemplary embodiment of the fork positioner of the present invention, designated generally as 10, is shown in FIG. 1 mounted on a vertically-reciprocating load carriage 12 of a mast 14 which is mounted on an industrial forklift truck 16. The fork positioner 10 comprises a fork-supporting frame 18 which may simply be fixedly mounted to fork bars 12*a*, 12*b* of the load carriage 12. However, as shown in FIG. 1, the frame 18 is preferably slidably mounted to the fork bars 12*a*, 12*b* by upper and lower hooks 18*a*, 18*b* respectively, the upper hook 18*a* slidably engaging a slide bushing 19 to permit the frame 18 to slide transversely along the fork bars. Such slidability of the frame 18 relative to the load carriage 12 enables selective side-shifting of the forks in unison in response to the extension or retraction of a side-shifting hydraulic piston and cylinder assembly 20 interacting between the frame 18, via a lug 22, and the carriage 12 via a bracket 24 hooked fixedly over the top of the upper fork bar 12*a* in a well-known, conventional manner.

Figure 2:
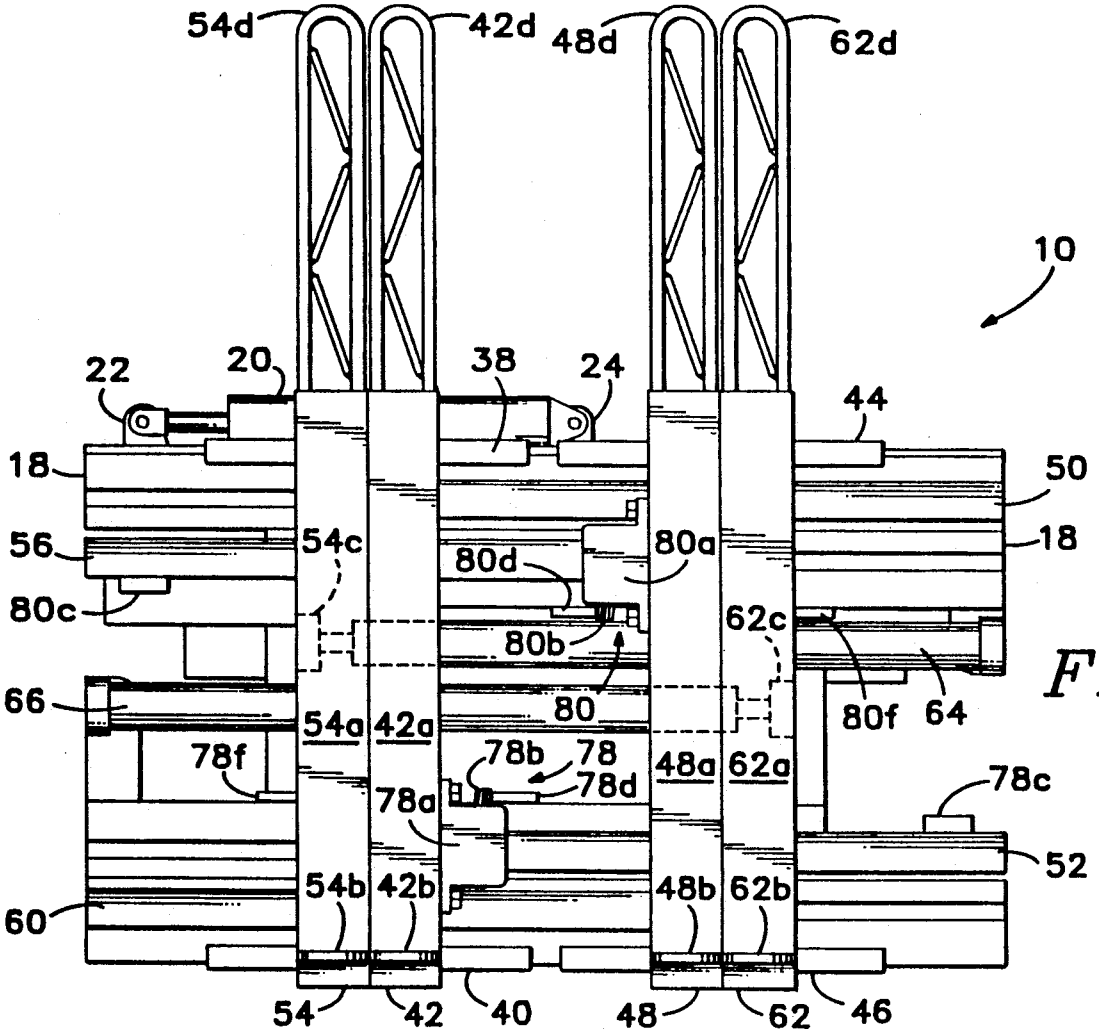
FIG. 2 is a front view of the fork positioner of FIG. 1 with the outer forks shown at their positions of minimum extension.
Figure 3:
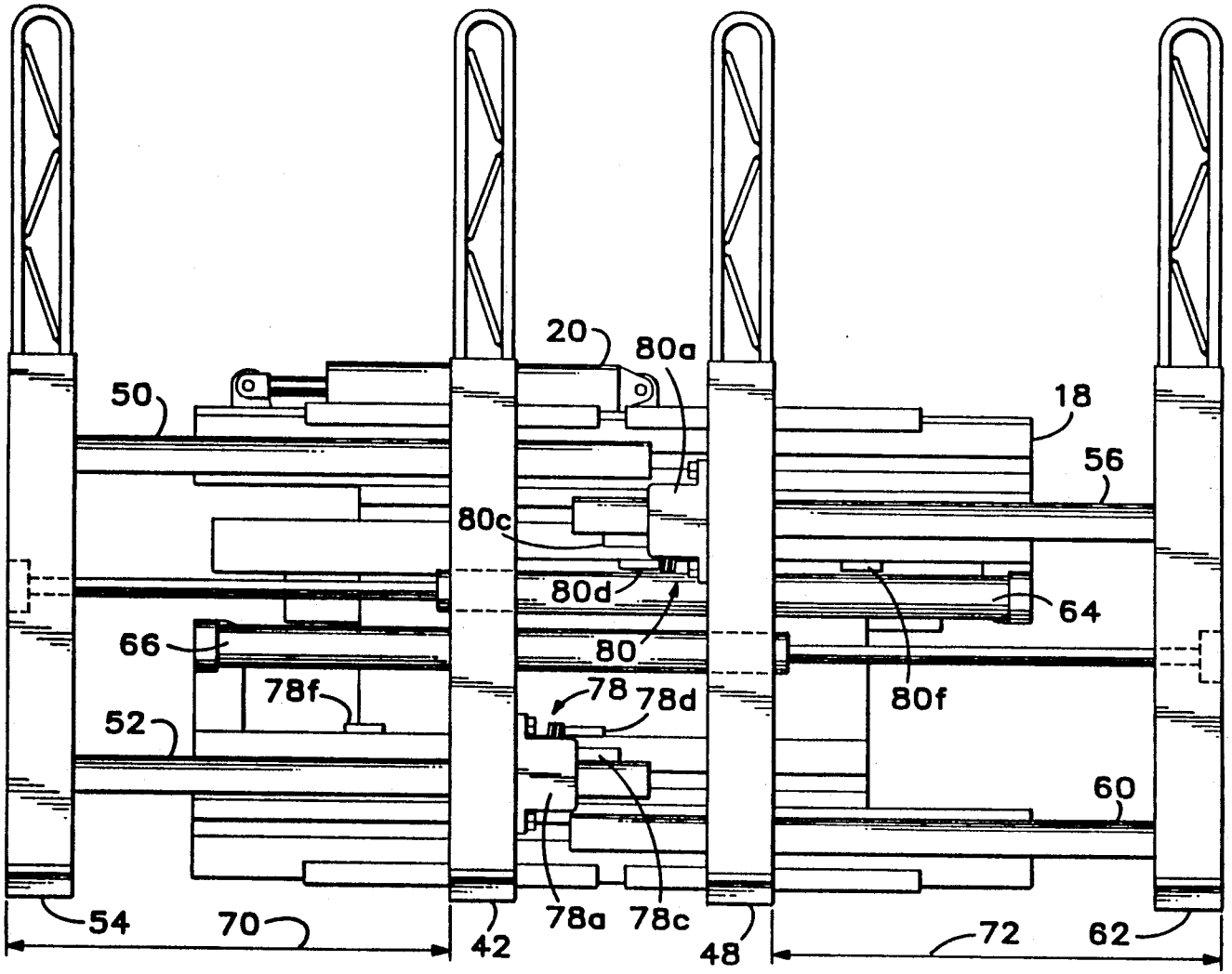
FIG. 3 is a front view of the fork positioner of FIG. 1 with the outer forks shown at the point of transition between their inner range of extension and their outer range of extension.
Figure 4:
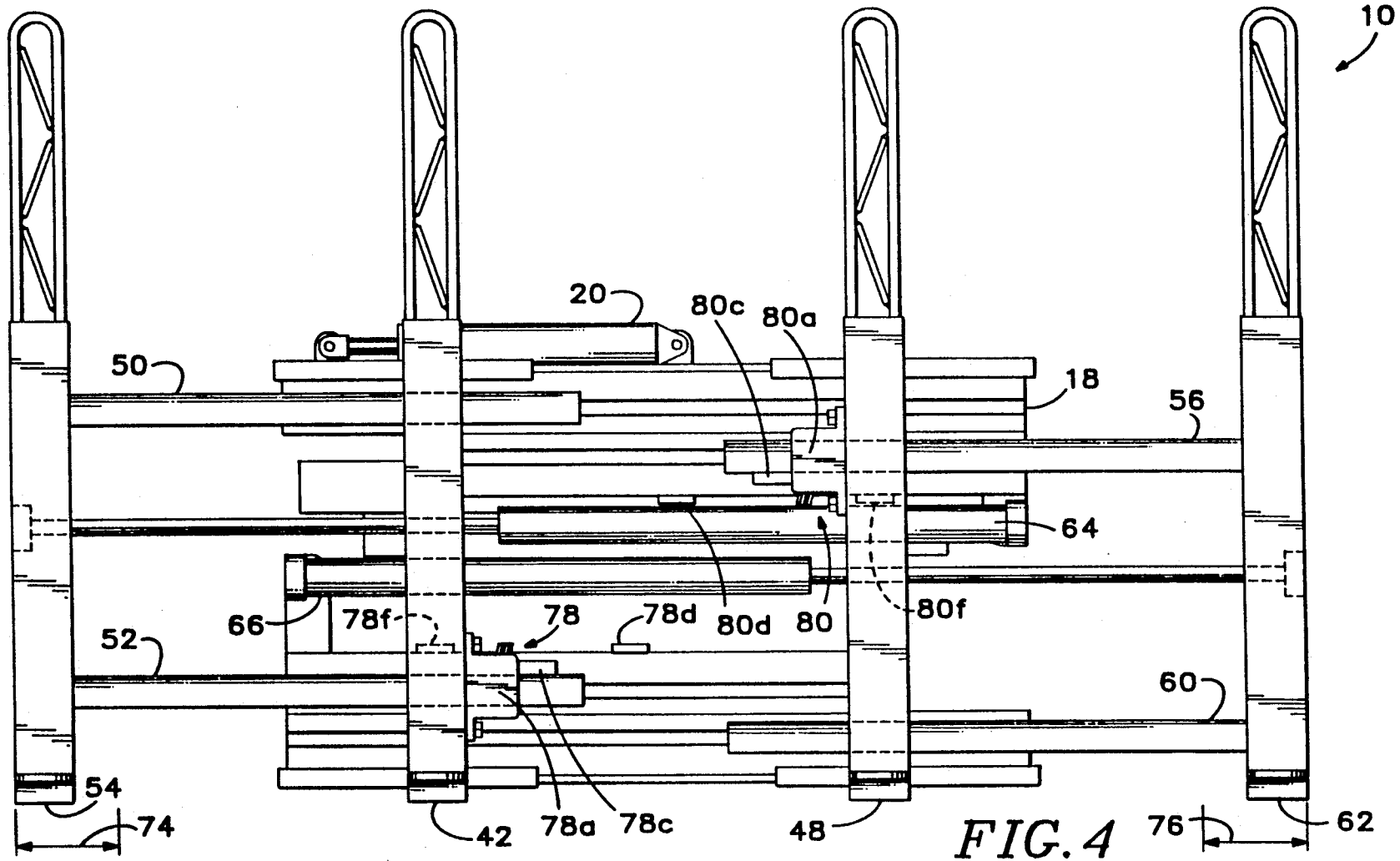
FIG. 4 is a front view of the fork positioner of FIG. 1 with the outer forks shown at their positions of maximum extension.

The fork-supporting frame 18 has multiple elongate slide guides 26, 28 and 30 extending transversely along its upper portion, and similar slide guides 32, 34 and 36 extending transversely along its lower portion. With reference also to FIGS. 2, 3 and 4, guides 26 and 32 slidably support channel-shaped slides 38 and 40 which are attached to the rear surface of inner fork 42, and also channel-shaped slides 44 and 46 which are attached to the rear surface of inner fork 48. Guides 28 and 36, on the other hand, slidably support elongate I-shaped slides 50 and 52 which are attached to the rear surface of outer fork 54. Finally, guides 30 and 34 slidably support elongate I-shaped slides 56 and 60 attached to the rear surface of outer fork 62. All of the sliding surfaces on the fork-supporting frame 18 are lined with slide bushings such as 21.

Each of the forks has an upright portion 42*a*, 48*a*, 54*a* and 62*a*, respectively, supported by the particular slides to which the fork is attached, and a forwardly-protruding load-supporting portion 42*b*, 48*b*, 54*b* and 62*b*, respectively, for insertion under a palletized load. Load backrest extensions 42*d*, 48*d*, 54*d* and 62*d*, respectively, protrude upwardly from the upstanding portions of the respective forks.

Outer fork 54 is selectively extended and retracted in response to the extension or retraction of a hydraulic piston and cylinder assembly 64 connected at one end to the frame 18 and at the other end to a bracket 54*c* protruding from the rear surface of the fork 54. Likewise, outer fork 62 is selectively extended and retracted by a hydraulic piston and cylinder assembly 66 connected between the frame 18 and a bracket 62*c* protruding from the rear surface of fork 62. The piston and cylinder assemblies 64 and 66 are connected to a conventional hydraulic valve assembly (not shown) which simultaneously extends and retracts them in response to manipulation of the valve by the lift truck operator. Extension of the piston and cylinder assemblies extends the outer forks 54 and 62 from their fully retracted positions shown in FIG. 2 first through a respective inner range of extension, designated as 70 and 72 in FIG. 3, and thereafter through an outer range of extension designated as 74 and 76 in FIG. 4. Alternatively, retraction of the piston and cylinder assemblies retracts the outer forks through the same ranges.

The outer forks 54 and 62 interact differently with their respective adjacent inner forks 42 and 48 depending upon whether the outer forks are in their inner range of extension or outer range of extension. These different interactions are determined by respective latch assemblies 78 and 80 which will be described hereafter in detail. In summary, the latch assemblies 78 and 80 operate automatically so that the inner forks 42 and 48 remain stationary during extension or retraction of the outer forks 54 and 62 within their inner range of extension 70, 72 as shown in FIG. 3. However, when the outer forks 54 and 62 are extended or retracted within their outer range of extension 74 and 76 as shown in FIG. 4, the latch assemblies 78 and 80 operate automatically to detachably fixedly connect the inner fork 42 to the outer fork 54, and the inner fork 48 to the outer fork 62, respectively, so that in the outer range of extension the adjacent inner and outer forks move in unison with each other with a predetermined fixed spacing between them.

Figure 5:
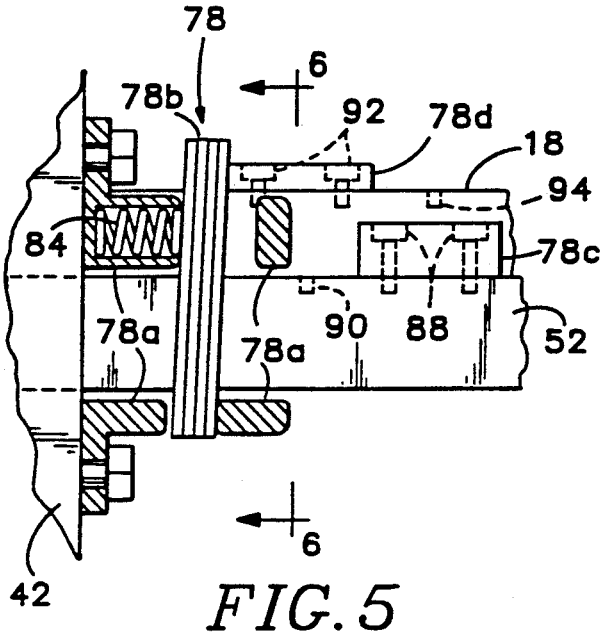
FIG. 5 is an enlarged, partially sectional view of the lower latch mechanism of the fork positioner of FIGS. 1–4, shown in its detached condition.
Figure 6:
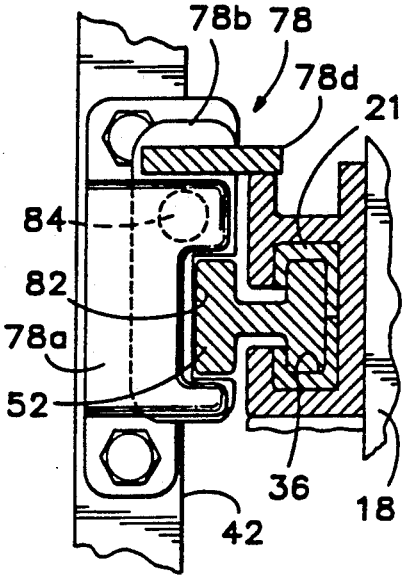
FIG. 6 is a partially sectional view taken along line 6–6 of FIG. 5.
Figure 7:
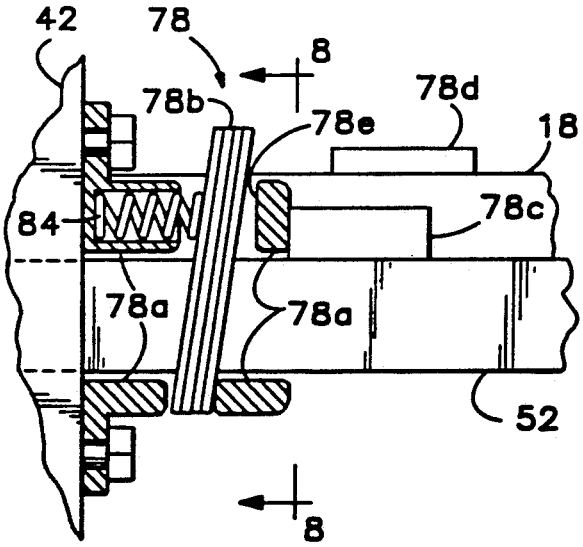
FIG. 7 is an enlarged, partially sectional view of the lower latch mechanism of the fork positioner of FIGS. 1–4, shown in its fixedly connected condition.
Figure 8:
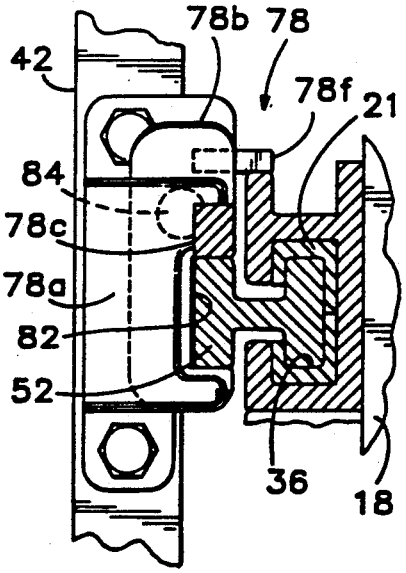
FIG. 8 is a partially sectional view taken along line 8–8 of FIG. 7.

With reference to FIG. 2, each latch assembly 78, 80 comprises a respective housing 78*a* 80*a* bolted to the side of a respective inner fork 42, 48, together with a respective spring-biased set of lock plates 78*b*, 80*b* within the housing for selectively detachably connecting to a respective slide 52, 56, a respective movable stop 78*c*, 80*c* mounted on the respective slide 52, 56, and a respective fixed stop 78*d*, 80*d* mounted on the frame 18. The operation of the lower latch assembly 78 will now be described in detail, it being understood that the upper latch assembly 80 operates in exactly the same way simultaneously in the opposite direction. With reference to FIG. 5, as the outer fork 54 is extended through its inner range of extension 70, the front portion of the slide 52 moves freely through a rectangular notch 82 (FIG. 6) formed in the locking plates 78*b*, thereby permitting the inner fork 42 to remain stationary pursuant to its own natural frictional resistance to movement. Such freedom of movement of the slide 52 relative to the notch 82 is made possible by the fact that the notch is somewhat wider than the front portion of the slide 52 and remains detached from the slide because the locking plates 78*b*, even though biased to an inclined position by a compression spring 84, remain in a relatively vertical attitude due to their abutment against stop 78*d* which is fixed to the frame 18. However, upon extension of the outer fork 54 from its inner range of extension into its outer range of extension, the stop 78*c* on the slide 52 abuts the housing 78*a* of the latch assembly, thereby pushing the housing and the locking plates 78*b* away from the fixed stop 78*d*. When this happens, the compression spring 84 tilts the locking plates 78*b* into a more inclined position as shown in FIG. 7, but not to the extent that the plates 78*b* touch the surface 78*e* of the housing 78*a*. (Prior to the abutment between stop 78*c* and the housing 78*a*, the spring 84 cannot push fork 42 away from stop 78*d* because the spring is not strong enough to overcome the frictional forces holding fork 42 in place.) The increased inclination of the locking plates 78*b* as shown in FIG. 7 causes the rectangular notch 82 of the plates to fixedly attach to the front portion of the slide 52 so as to rigidly resist any retraction of the slide 52 relative to the inner fork 42. After the locking plates 78*b* fixedly attach to the slide 52, outer fork 54 and inner fork 42 proceed outwardly in unison through the outer range of extension, the locking plates 78*b* fixedly preventing any narrowing of the spacing between the forks 54 and 42, and the abutment of the stop 78*c* with the housing 78*a* fixedly preventing any widening of the spacing. Accordingly, such spacing is maintained fixedly throughout extension or retraction of the outer fork 54 within its outer range of extension 74.

Upon retraction of the outer fork 54 from its outer range of extension 74 into its inner range of extension 70, locking plates 78*b* once more come into abutment with the fixed stop 78*d* thereby moving the plates from their inclined, locked position shown in FIG. 7 to the more vertical, detached position relative to the slide 52 as shown in FIG. 5. At this point the retraction of the inner fork 42 is halted by the stop 78*d* while the retraction of the outer fork 54 continues due to the detachment of the locking plates 78*b* from the slide 52. The outer fork 54 may then be brought to its fully-retracted position as shown in FIG. 2.

The fixed spacing between the interconnected inner and outer forks in the outer range of extension can be adjusted in any of several different ways. One way is to change the position of the stop 78*c* relative to the slide 52 by removing bolts 88 (FIG. 5) and repositioning the stop 78*c* in different bolt holes such as 90. This changes the spacing between the outer fork 54 and the inner fork 42 at the point where locking of the inner fork to the outer fork slide 52 occurs. Another way would be to place removable shims of variable thickness on the exterior of the housing 78*a* at the point where the stop 78*c* abuts the housing, thus likewise changing the spacing between the outer and inner forks at the point where locking occurs. Similarly, the position of full retraction of the forks can be adjusted by changing the position of the fixed stop 78*d* on the frame 18 by removing bolts 92 and repositioning the stop using different bolt holes such as 94.

Additional fixed stops 78*f*, 80*f* may be mounted on the frame 18 to prevent hyperextension of the forks by abutment with the respective housings 78*a*, 80*a*. Preferably, the piston and cylinder assemblies 64, 66 limit extension prior to abutment between the housings 78*a*, 80*a* secondary limits.

As will be apparent to those skilled in the art from the foregoing description, many alternative forms of detachable latch or clutch assemblies, other than that specifically shown in the preferred embodiment, would be suitable for the purpose. Also, although the inner forks 42 and 48 in the preferred embodiment are movably supported directly on the frame 18, it would be within the scope of the invention to movably support them indirectly on the frame, such as by slidably mounting them on the slides 50, 56 and selectively detachably latching them alternatively either to the frame or to their respective slides automatically in response to the movement of the outer forks.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A lift truck positioner for multiple pairs of forks, said positioner comprising:

(a) a fork-supporting frame;

(b) a pair of outer forks movably supported by said frame so that said outer forks may be moved selectively toward or away from each other either within an inner range of extension or within an outer range of extension located beyond said inner range of extension;

(c) powered actuating means operatively interconnecting said frame with said outer forks for selectively moving said outer forks relative to said frame;

(d) a pair of inner forks, located between said outer forks, movably supported on said frame so that said inner forks may be moved selectively toward or away from each other along the same direction that said outer forks are movable toward or away from each other; and (e) latch means for selectively connecting a respective one of said inner forks rigidly to a respective adjacent one of said outer forks automatically in response to the movement of said outer forks from said inner range of extension into said outer range of extension, so as to cause said respective adjacent ones of said inner and outer forks to move together in unison with a predetermined spacing therebetween and rigidly prevent any relative movement therebetween which would narrow said spacing while said outer forks are within said outer range of extension, said latch means including means for selectively detaching said respective ones of said inner and outer forks from each other automatically in response to the movement of said outer forks from said outer range of extension into said inner range of extension.

2. The fork positioner of claim 1 wherein said latch means comprises means for rigidly preventing both narrowing and widening of said spacing between said respective ones of said inner and outer forks while said outer forks are within said outer range of extension.

3. The fork positioner of claim 1 wherein said latch means includes means for selectively adjusting said predetermined spacing between said respective ones of said inner and outer forks.

4. The fork positioner of claim 1 including a pair of slides movably mounted on said frame each supporting a respective one of said outer forks, said latch means including means for selectively detachably interconnecting said respective ones of said inner and outer forks by detachably rigidly connecting each inner fork to a respective one of said slides and thereby preventing movement of the inner fork with respect to the slide in a direction which would narrow the spacing between said respective ones of said inner and outer forks.

5. The fork positioner of claim 4 wherein said inner forks are vertically supported on said frame independently of said slides.

6. A lift truck fork positioner for multiple pairs of forks, said positioner comprising:

(a) a fork-supporting frame;

(b) a pair of outer forks movably supported by said frame so that said outer forks may be moved selectively toward or away from each other either within an inner range of extension or within an outer range of extension located beyond said inner range of extension;

(c) powered actuating means operatively interconnecting said frame with said outer forks for selectively moving said outer forks relative to said frame;

(d) a pair of inner forks, located between said outer forks, movably supported on said frame so that said inner forks may be moved selectively toward or away from each other along the same direction that said outer forks are movable toward or away from each other;

(e) latch means for selectively detachably connecting a respective one of said inner forks fixedly to a respective adjacent one of said outer forks automatically in response to the movement of said outer forks from said inner range of extension into are outer range of extension, so as to cause said respective adjacent ones of said inner and outer forks to move together in unison with a predetermined spacing therebetween and fixedly prevent any relative movement therebetween which would narrow said spacing while outer forks are within said outer range of extension; and (f) a pair of slides movably mounted on said frame each supporting a respective one of said outer forks, said latch means including means for selectively detachably interconnecting said respective ones of said inner and outer forks by detachably fixedly connecting each inner fork to a respective one of said slides and thereby preventing movement of the inner fork with respect to the slide in a direction which would narrow the spacing between said respective ones of said inner and outer forks.

7. The fork positioner of claim 6 wherein said inner forks are vertically supported on said frame independently of said slides.

* * * * *

UNITED STATES PATENT AND TRADEMARK OFFICE

CERTIFICATE OF CORRECTION

PATENT NO. : 5,096,363

DATED : March 17, 1992

INVENTOR(S) : Harry F. Weinert et al.

It is certified that error appears in the above-identified patent and that said Letters Patent is hereby corrected as shown below:

Col. 4, line 32 "After "78a" insert a comma (,).

Col. 5, line 51 After "80a" insert --and the stops 78f, 80f so that the stops serve only as--.

Col. 6, line 6 After "lift truck" insert --fork--.

Signed and Sealed this

Twentieth Day of July, 1993

*Attest:*

Michael K. Kirk

MICHAEL K. KIRK

*Attesting Officer*

*Acting Commissioner of Patents and Trademarks*